United States Patent [19]

Wemmer

[11] 4,057,940

[45] Nov. 15, 1977

[54] CONTROL FOR SAND BLASTING NOZZLE

[76] Inventor: Otto Wemmer, 3710 Greenbriar Drive, Columbia, S.C. 29206

[21] Appl. No.: 746,939

[22] Filed: Dec. 2, 1976

[51] Int. Cl.[2] ..... B24C 7/00

[52] U.S. Cl. ..... 51/438

[58] Field of Search ..... 51/12, 8 HD, 438; 222/468, 475; 239/348; 15/375, 421

[56] References Cited

U.S. PATENT DOCUMENTS

| | | | |
|---|---|---|---|
| 2,176,139 | 10/1939 | Lofgren | 15/421 X |
| 3,039,463 | 6/1962 | Dickey | 15/421 X |
| 3,048,876 | 8/1962 | Kemnitz | 15/421 X |
| 3,440,681 | 4/1969 | Hixson | 15/421 X |
| 3,828,478 | 8/1974 | Bemis | 51/12 X |
| 3,834,082 | 9/1974 | Grudzinski | 51/12 |
| 3,922,817 | 12/1975 | Wemmer | 51/12 |

*Primary Examiner*—Donald G. Kelly
*Attorney, Agent, or Firm*—Townsend M. Belser, Jr.

[57] ABSTRACT

A control apparatus for a sand blasting nozzle is shown having means to induce a suction in the sand delivery conduit associated with the nozzle. A sliding valve structure for controlling the induced vacuum in the sand delivery conduit is provided along with a valve for controlling flow of the fluid medium for impelling the sand. The system makes use of high velocity air or steam or high pressure water or similar fluid for inducing the required suction in the sand delivery line and for driving the sand against the object to be blasted. Handle means form part of the apparatus to control the direction of the stream of abrasive and carrier fluid blasted from the nozzle portion of the assembly.

8 Claims, 4 Drawing Figures

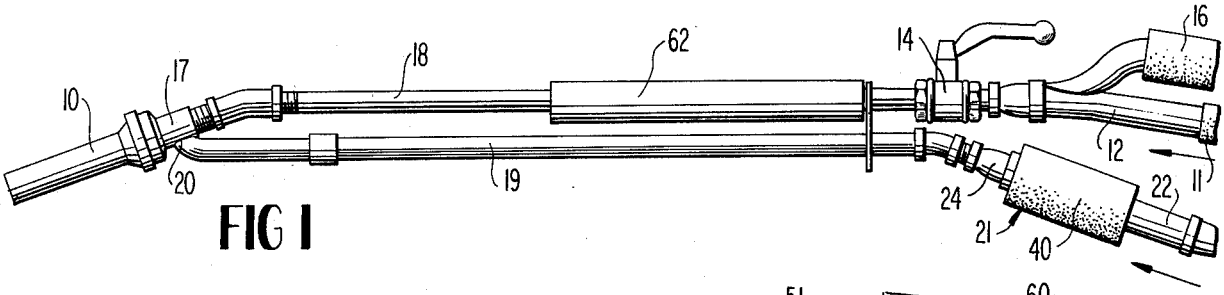
FIG 1
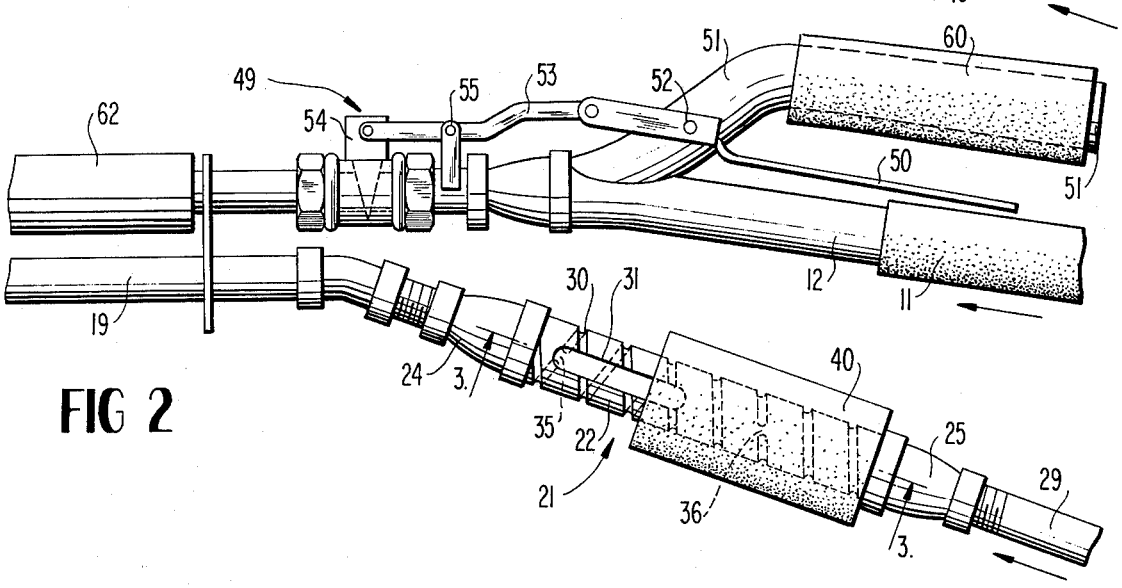
FIG 2
FIG 3
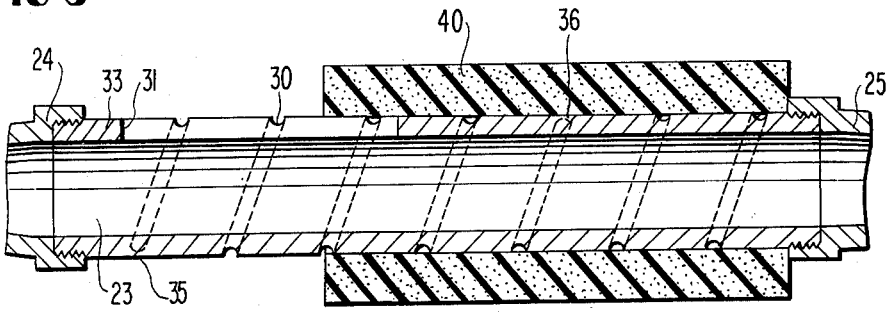
FIG 4
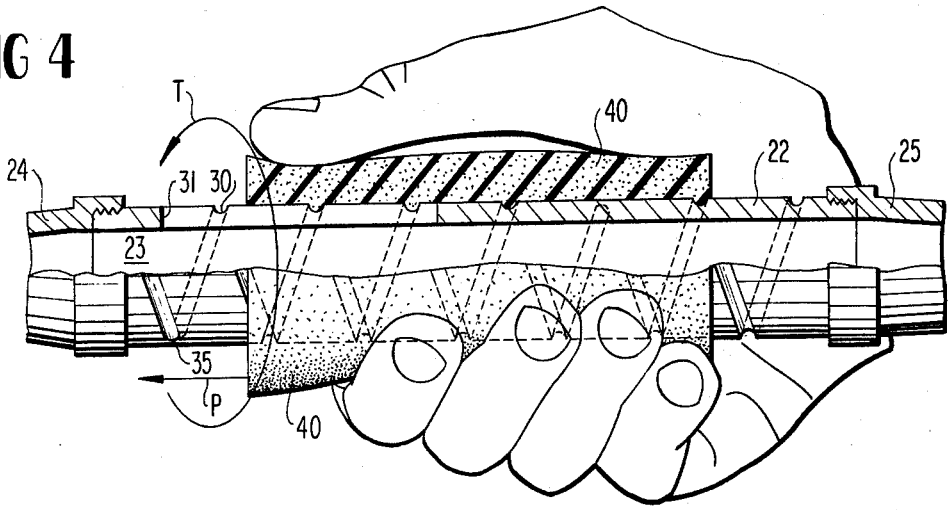

CONTROL FOR SAND BLASTING NOZZLE

BACKGROUND

Sand blasting systems for cleaning surfaces, stone sculpturing, and other uses of high energy abrasive streams are well known. Such an apparatus usually includes a supply means for storage and delivery of abrasive granules or grit to a blasting gun and a delivery system for a fluid stream capable of picking up the grit and passing the composite mixture of grit and carrier fluid through a nozzle on the gun which is held by an operator. The operator must control the quality of the composite stream, the quantity of grit picked up for the blasting operation, and the direction of the blasting medium as it impinges upon the object being worked upon. The type of cleaning or removal action depends upon the kind of abrasive particles being used as grit, the flow characteristics of the composite stream, and the quantity of grit injected therein, all of which must be readily controlled by the operator at all times.

Several known systems adapted for this purpose are shown in U.S. patents to Bemis, U.S. Pat. Nos. 3,828,478 of Aug. 13, 1974, and to Wemmer 3,922,817 Dec. 2, 1975. Those constructions provide a supply means for dribbling abrasive grit from a reservoir means into a feed line connected to the blasting gun. The grit is delivered along the feed line to the nozzle of the gun by inducing a suction at the nozzle end of the grit feed line which draws a stream of air into the opposite end of the feed line behind the grit to carry it to the nozzle. Control of the degree of suction induced in the feed line causes more or less of the abrasive grit to be delivered to the nozzle and means are provided under the control of the operator to adjust the suction. Typically, a high speed working fluid such as steam or high pressure water is made to flow through a venturi where the grit feed line enters the nozzle assembly in order to induce a suction in the feed line. Air inlets with conventional valves have been positioned between the grit supply means and the feed line outlet to bleed more or less air into the grit feed line to effect the desired control of abrasive grit delivered to the nozzle as shown in Wemmer.

DESCRIPTION OF INVENTION

An improved suction control valve structure is here provided to adjust the quantity of air to be bled into the grit delivery line in a suction fed system for a sand blast nozzle or the like. An improved gripping structure is also provided so that the operator can hold the blasting gun securely and control the direction and velocity of the blast and its composition at all times, without releasing his hold on the gun. The degree of grit suction is adjusted merely by twisting one of the grips serving as one of the handles of the nozzle assembly. A clockwise twist increases and a counterclockwise twist decreases the suction prevailing at the outlet end of the grit feed line to thereby control the quantity of grit flowing through that line into the nozzle where it is picked up by and mixed with the carrier fluid.

For this purpose, a hand grip in the form of a tube or sleeve surrounding the grit feed line is arranged to serve also as an air inlet valve. The grip is made of an elastic deformable material and is carried on a suitable support or valve body in the feed line. The surface of the support serves as the valve seat and preferably has a spiral channel resembling a screw thread. The channel may be defined either by a raised ridge on or by a depressed groove in the support surface. The support includes a conduit forming a portion of the feed line and an aperture to allow air to enter into the feed line. The tubular grip may be turned on the support and, by reason of its engagement with the threaded means, will move longitudinally along the surface of the support to either cover or uncover the aperture depending on the direction of twist. Rotational movement of the grip thus serves to open or close the aperture in the grit supply line to control the volume of air that may be bled therein, reducing or increasing the suction induced in the grit delivery conduit to feed less or more grit, respectively, into the blasting stream.

Ideally, the valve or grip is a sleeve made of an elastic, closed-cell foam rubber or resin. The valve seat is cylindrical and has a spiral groove cut into its periphery to form relatively deep screw-like threads into which the grip deforms under compression, such as exerted by squeezing the hand. As the operator turns the grip, the depression of the elastic material into the grooves causes the grip to move forward or back as it rotates around the valve seat. It follows that the aperture is covered or uncovered by the sleeve as it moves lengthwise along the seat and the quantity of air pulled into the sand delivery conduit through the aperture is controlled. As more of the aperture is uncovered, more air bleeds into the conduit and less suction is available to pull the grit into the sand blast nozzle. As more of the aperture is covered, less air bleeds in and the suction increases. When the aperture is entirely covered, it is completely sealed by the grip due to the tight elastic fit of the sleeve on the outside of the valve seat. Preferably, the fit is sufficiently tight to cause at least some surface compression and bowing of the material into the groove even in the absence of hand compression. Therefore, with the sleeve in its forward most position, the maximum degree of suction attainable with the velocity of fluid flow in the nozzle prevails in the feed conduit.

The foamed resin sleeve thus makes an ideal handle and suction control valve. It is comfortable to touch and since it is inherently elastic, it can be readily designed to cooperate with the valve seat. By making its internal diameter less than the outside diameter of the seat, the sleeve is deformed to elastically engage the seat and seal the periphery thereof against any flow of air into the conduit when that valve member is in its forward, closed position. Also, air can enter only through so much of the bleed aperture as is uncovered by moving the sleeve rearward, giving close positive control of the grit feeding action.

DRAWINGS

FIG. 1 is a side view of one form of the sand blast gun assembly showing the suction control valve in its closed position;

FIG. 2 is an enlarged view of the carrier fluid and grit feed structures shown in FIG. 1 and shows an alternate form of carrier fluid control valve means with the suction control valve in the grit feed line open to reduce the degree of suction in that conduit;

FIG. 3 is an enlarged sectional view looking along line 3—3 of FIG. 2; and

FIG. 4 is a partial sectional view similar to FIG. 3 showing the inner surface of the valve sleeve deformed into the spiral channel by the hand of an operator and illustrating clockwise turning of the sleeve to close the valve.

DETAILED DESCRIPTION

The blast gun assembly here shown for directing an abrasive stream of fluid and grit onto an object to be worked may be associated with any conventional sand blasting equipment where a carrier fluid moves at relatively high velocity over the outlet of an abrasive grit feed pipe adapted to deliver a grit component to the carrier fluid. In such apparatus, the suction induced in the abrasive grit feed pipe by the carrier fluid flow is used to cause a flow of abrasive grit from a remote supply container through the infeed conduit to the blast gun, all as taught in the prior art disclosures mentioned above.

In such an apparatus, a blast nozzle 10 may be supplied with a carrier stream of water delivered at high pressure through a flexible pipe 11 connected to a fitting 12. The velocity of the flow of the high pressure fluid stream into the inlet of the blast nozzle 10 is controlled by a throttle valve 14. The stream of fluid passing through valve 14 flows through pipe 18 to the spray nozzle 10 to be directed to the surface being worked upon by means of handles 16 and the grip afforded by valve assembly 21 as discussed further below.

A feed conduit 19 for delivering abrasive grit material to the nozzle 10 so as to add it to the carrier fluid and form a composite blasting stream is connected at 20 to a venturi section 17 adjacent to the inlet side of the nozzle. As the high velocity flow of fluid rushes through the venturi toward the outlet of the nozzle, a suction is induced in conduit 19. The conduit 19 and its associated grit supply system for feeding abrasive grit to the sand blast nozzle of this invention is designed to operate in a manner similar to those grit delivery systems shown in the Bemis and Wemmer patents wherein the inlet end of supply conduit 29 is open to the atmosphere at or near the grit supply reservoir. In this prior art grit feed system, grit falls by gravity into conduit 29 near its open end (not shown) and the suction induced in that conduit draws air from the atmosphere through the conduit's open end and past the supply point to pick up the grit and move it through connecting conduit 19 to the grit infeed at the nozzle.

The volume of the flow of grit must be varied from time to time depending upon the kind of grit being used and the degree of surface removal or abrasive scouring to be performed. The quantity of grit flow into the nozzle 10 is most efficiently controlled by direct variation of the magnitude of the suction prevailing in the conduit 19. Changing the velocity and quantity of carrier fluid by adjustment of throttle valve 14 can cause large and essentially uncontrollable variations in the degree of suction in conduit 19. The degree of grit flow control afforded by direct control of suction through an air suction valve is much greater.

In order to control the feed delivery suction in conduit 19 of the present invention, a valve assembly 21 is provided in the conduit and preferably has a smooth surfaced cylindrical body portion 22. The valve body has a passage or conduit 23 extending axially therethrough and connected in line with conduits 19 and 29, the opposite ends of the body 22 being provided with suitable connecting fittings 24 and 25 for this purpose. It will be noted that the valve assembly is connected into the grit feed conduit between the outlet 20, where suction is produced, and the opposite open end of the feed conduit that is associated with the grit supply means (not shown).

The periphery of the valve seat is provided with a relatively steeply pitched spiral groove forming threads 30 which are cut deeply into the body wall 33 and extend from one end to the other end of the outer periphery of the seat. The seat also has an elongated slot or aperture 31 cut through the wall 33 into the valve passage which is thereby exposed to the atmosphere. The slot can be formed at any peripheral position around the circumference of the valve seat, but is cut in the side thereof for purposes of illustration as best seen in the view of FIG. 2.

A tightly fitting resilient sleeve 40 of closed cell foam rubber or like material is fitted around the outer periphery of the cylindrical valve seat, the sleeve being formed with the inner diameter of its tubular cavity smaller than the outer diameter of the valve seat to cause the sleeve to elastically and frictionally engage the seat so as to seal the aperture 31 against any inward flow of air when the sleeve entirely covers the slot, thereby providing a maximum suction condition. The spiral groove 30 is interrupted or blocked by wall segments 35 and 36 which are continuous with the smooth outer surface of seat 22 and cooperate with the inner surface of the elastic sleeve to prevent any inflow of air along the groove channel when the valve is fully closed.

The contraction of the elastic sleeve around the valve seat causes the foam material adjacent to the seat surface to compress and deform slightly into the grooves 30, thereby increasing the frictional engagement holding the tubular valve in position on the periphery of the valve seat. Movement of the valve must therefore be intentional and can be affected only by positive rotation of the sleeve or application of a strong axial sliding force as described below. The length of the sleeve in proportion to the length of the valve seat is such that the sleeve may be moved lengthwise along the valve body as clearly shown in FIG. 2 to slowly cover or uncover slot 31. When the sleeve 40 is screwed to the right by twisting it in the direction T around the body 22, it moves forward in the direction P to cover the slot as shown in FIG. 4. Twisting the sleeve to the left moves it rearward to uncover the slot.

The sleeve cooperates with the deeply cut thread means 30 so as to be precisely adjustable longitudinally along the valve seat by reason of the elastic interfit of the sleeve with the thread grooves. When the slot 31 is uncovered, air is allowed to enter passage 23 and reduce the degree of suction in conduit 29 which serves as the grit delivery conduit between the valve 21 and the grit supply system (not shown). When suction is reduced, less grit will be picked up for delivery into the conduit 19 and to nozzle 10, thereby reducing the grit to carrier fluid ratio in the blast stream.

The on-off control of the carrier fluid flowing from a high pressure water pump means (not shown) to the spray nozzle 10 may be controlled by a lever type throttle valve 49 actuated by a trigger 50 as shown in the modification of FIG. 2. This trigger can be manipulated more easily by the operator during the spraying operation than can the rotary valve 12 shown in FIG. 1, although the latter is more rugged. The trigger 50 is pivotally mounted on bearing means 52 carried on the side of the handle 51 and operates lever 53 which similarly pivots at 55 to raise or lower the stem 54 of valve 49. With this structure, the flow of high pressure fluid can be turned on and off without releasing the handle 51. It should be noted that the operator can simultaneously adjust the flow of grit through conduit 19 by turning sleeve 40 which would be gripped in the operator's other hand as shown in FIG. 4.

The sleeve 40, as above described, is preferably formed as a cylindrical or tubular body that resiliently contracts against the valve seat to provide a tight seal between those components as previously explained. It is possible that other cylindrical means could be adapted to this use, but only foam rubber, whether of natural or synthetic resin, has been found satisfactory as a valve material. Preferably, the foam is of the closed cell type. It has been found that a tubular sleeve made of foam material meeting the ASTM Specification D-1056 is ideal for this application, a sleeve made of acrylonitrile butadiene polyvinyl chloride which has been foamed to produce an elastic closed cell product being preferred. These materials may be elastically fitted onto the valve seat to deform into the thread-like grooves 30 here disclosed to provide the desired suction control means for adjusting the grit flow to a sand blast nozzle. As indicated, the foamed resin also forms a comfortable hand grip and its elastic deformable properties provide a sleeve that may be turned on the periphery of the valve seat while cooperating with threaded grooves to move axially in either direction depending upon the direction of rotation about the longitudinal valve axis. Furthermore, this material coacts with the valve seat to precisely control the bleeding of air through slot 31 into passage 23, thereby precisely controlling the quantity of grit flowing through conduit 19. However, it is to be understood that the engagement between the sleeve and the seat is such that the valve may be quickly closed or opened by a strong axial sliding force with minimum compression so that the closed cell material is moved transversely over the lip of the grooves instead of following the spiral groove axis. Such a quick acting force for closing the valve would be applied in the direction P of FIG. 4.

If steam is used to drive the flow of the jet from nozzle 10 or if the carrier fluid is otherwise hot, a second foam rubber sleeve 60 may be provided as shown in FIG. 2 to insulate the hand grip 51. A third sleeve 62 may be carried on pipe 18 so that two alternate pairs of spaced apart grip means, 40 and 60 or 40 and 62, are provided, one grip for each hand of the operator. The spaced apart grips provide a very convenient handle arrangement for directing the jet spray or sand blast while at the same time means are incorporated to easily control the blast composition itself through either or both the valve 54 and the valve 21. Thus, both the sand flow and the carrier flow can be adjusted without the operator having to release his grip on the spraying means at any time. The independent control of carrier fluid and grit, which may be adjusted simultaneously, satisfies the many variable conditions required of sand blasting operations. It should be noted that the structure of the foam resin sleeve is also quite practical insofar as providing an insulated hand grip when utilizing hot carrier fluids in the blast gun.

The above description merely covers the preferred forms of this invention and it is possible that other modifications and variations will occur to those skilled in the art. For example, the cylindrical valve seat may be oval in cross section or have some other non-circular shape. Also the groove or ridge defining the spiral channel need not be continuous but could be a series of aligned grooves or ridges. Such structural changes and alterations fall within the scope of the following claims.

I claim:

1. In a sand blasting apparatus having a blasting fluid supply, a discharge nozzle with a suction inducing means and a grit delivery conduit leading from a supply of grit to the suction inducing means of said sand blasting nozzle, a valve assembly positioned in said grit conduit between said suction inducing means and said grit supply and comprising an elongated valve body having a cylindrical wall disposed about the longitudinal axis thereof to define a passage extending therethrough, said valve body being connected in said conduit with said passage in line therewith; a smooth outer surface around the periphery of said valve body defining a cylindrical valve seat exposed to the atmosphere; spiral thread means on the cylindrical surface of said seat; an aperture extending along said seat and through said wall to provide an opening between the atmosphere and said passage; and a resilient deformable cylindrical sleeve carried on said body and surrounding a portion of said valve seat, the inner portion of said sleeve being deformed by engaging said thread means and said sleeve being arranged for longitudinal movement along said seat surface between a first position to cover and seal said aperture and a second position to uncover said aperture and expose said passage to the atmosphere upon rotation of said sleeve in contact with said thread means, thereby adjustably controlling the degree of suction induced in the grit delivery conduit by the suction inducing means of said nozzle.

2. A structure as in claim 1 wherein said sleeve is formed of an expanded closed cell rubber latex.

3. A structure as in claim 2 wherein said sleeve is an elastic closed cell foamed product made from an acrylonitrile butadiene polyvinyl chloride resin.

4. In a sand blasting apparatus as in claim 1 with said blasting fluid supply including a second conduit leading from a supply of high pressure fluid to said nozzle, a throttle valve in said second conduit to control the flow of high pressure fluid through said second conduit and a sleeve on said second conduit adjacent to said throttle valve whereby the sleeve of said suction valve and said second sleeve together serve as insulated handles for the hands of an operator to control the direction of the blasting stream discharged by said said blasting nozzle.

5. A structure as in claim 4 wherein both of said sleeves are formed of an elastic closed cell foamed resin.

6. In a sand blasting apparatus having a blasting fluid supply, a discharge nozzle with a suction inducing means and a grit delivery conduit leading from a supply of grit to the suction inducing means of said sand blasting nozzle, a valve assembly positioned in said grit conduit between said suction inducing means and said grit supply and comprising an elongated valve body having a wall surrounding a longitudinal axis thereof to define a passage extending therethrough, said valve body being connected in said conduit with said passage in line therewith; a smooth outer surface around the periphery of said valve body defining a cylindrical valve seat exposed to the atmosphere; and aperture in said seat extending through said wall to provide an opening between the atmosphere and said passage; and a resilient sleeve of closed cell foam rubber carried on said body and surrounding a portion of said valve seat, said sleeve being formed with an inner diameter smaller than the outer diameter of said seat so that when carried by said body said sleeve is deformed and frictionally engages said valve seat around the circumference thereof, and said sleeve being arranged for longitudinal movement along said seat surface between a first position to cover and seal said aperture and a second position to uncover said aperture and expose said passage to the atmosphere so as to adjustably control the degree of suction induced in the grit delivery conduit by the section inducing means of said nozzle.

7. A structure as in claim 6 wherein said valve body includes thread means arranged on said seat for engaging said sleeve to adjustably move the sleeve relative to said aperture upon rotation of the sleeve around the valve seat.

8. A structure as in claim 6 wherein said aperture is comprised of an elongated slot.

* * * * *